US010926901B2

(12) United States Patent
Kim

(10) Patent No.: US 10,926,901 B2
(45) Date of Patent: Feb. 23, 2021

(54) BLISTER PACKING DEVICE AND BLISTER PACK PACKING METHOD

(71) Applicant: JVM CO., LTD., Daegu (KR)

(72) Inventor: Jun-ho Kim, Daegu (KR)

(73) Assignee: JVM CO., LTD., Daegu (KR)

( * ) Notice: Subject to any disclaimer, the term of this patent is extended or adjusted under 35 U.S.C. 154(b) by 176 days.

(21) Appl. No.: 15/923,770

(22) Filed: Mar. 16, 2018

(65) Prior Publication Data

US 2018/0265232 A1 Sep. 20, 2018

(30) Foreign Application Priority Data

Mar. 16, 2017 (KR) ..... 10-2017-0032956

(51) Int. Cl.

| | |
|---|---|
| ***B65B 11/52*** | (2006.01) |
| ***B65B 5/10*** | (2006.01) |
| ***B65B 35/04*** | (2006.01) |
| ***B65B 43/54*** | (2006.01) |
| ***B65B 5/12*** | (2006.01) |
| ***B65B 35/44*** | (2006.01) |
| ***B65B 57/18*** | (2006.01) |
| ***B65B 39/00*** | (2006.01) |

(52) U.S. Cl.

CPC ..... *B65B 11/52* (2013.01); *B65B 5/103* (2013.01); *B65B 5/12* (2013.01); *B65B 35/04* (2013.01); *B65B 35/44* (2013.01); *B65B 39/005* (2013.01); *B65B 39/007* (2013.01); *B65B 43/54* (2013.01); *B65B 57/18* (2013.01); *B65B 2039/009* (2013.01)

(58) Field of Classification Search

CPC ..... B65B 35/04; B65B 35/44; B65B 39/005; B65B 39/007; B65B 11/52; B65B 5/103; B65B 5/12; B65B 43/54; B65B 2039/009; B65B 57/18

See application file for complete search history.

(56) References Cited

U.S. PATENT DOCUMENTS 3,064,406 A * 11/1962 Kennedy ..... B65B 5/103 53/240
3,206,062 A * 9/1965 Rappaport ..... B65B 5/103 221/7
4,465,150 A * 8/1984 Matsumoto ..... G01G 13/18 177/25.12
4,674,259 A * 6/1987 Hills ..... B65B 39/007 53/202

(Continued)

FOREIGN PATENT DOCUMENTS

DE 102014108732 B3 * 10/2015 ..... B65B 35/04

*Primary Examiner* — Thomas M Wittenschlaeger

(74) *Attorney, Agent, or Firm* — Osha Bergman Watanabe & Burton LLP

(57) ABSTRACT

A blister packing device and a blister pack packing method are provided. The blister packing device includes a frame, a main hopper attached to the frame and configured to receive tablets, a rotation module located below the main hopper and including a plurality of cells and configured to sequentially receive the tables in the plurality of cells and convey the plurality of cells containing the tablets to a discharge region, and a buffer including a plurality of areas physically divided and configured to receive the tablets in the plurality of areas corresponding to a plurality of cells located in the discharge region and discharge the tablets to a blister pack.

13 Claims, 16 Drawing Sheets

(56) References Cited

U.S. PATENT DOCUMENTS 6,185,901 B1 * 2/2001 Aylward ..... B65B 5/103 266/131
6,357,495 B1 * 3/2002 Baroncini ..... B65B 5/103 141/129
6,422,418 B1 * 7/2002 Collins ..... B07C 3/082 198/445
6,681,550 B1 * 1/2004 Aylward ..... B65B 5/103 53/244
6,792,736 B1 * 9/2004 Takahashi ..... B65B 37/08 53/237
6,925,774 B2 * 8/2005 Peterson ..... B65B 5/103 53/152
7,004,353 B2 * 2/2006 Yamamoto ..... B65B 5/103 221/277
7,784,244 B2 * 8/2010 Siegel ..... B65B 5/103 53/151
7,878,366 B2 * 2/2011 Cicognani ..... B65B 5/08 198/771
8,424,274 B2 * 4/2013 Aylward ..... B65B 65/08 53/473
8,807,324 B2 * 8/2014 Baroncini ..... B65B 9/045 198/471.1
9,199,748 B2 * 12/2015 Cremer ..... B65B 43/60
9,434,487 B2 * 9/2016 Bassani ..... B65B 43/42
9,776,755 B2 * 10/2017 Kondo ..... B65B 57/10
10,086,965 B2 * 10/2018 Hellenbrand ..... B65B 57/14
2010/0256808 A1 * 10/2010 Hui ..... G07F 7/025 700/225
2013/0118638 A1 * 5/2013 Hopkins ..... A61J 3/074 141/1
2014/0318086 A1 * 10/2014 Ishizuka ..... B65B 35/06 53/475
2016/0302468 A1 * 10/2016 Robinson ..... B65B 39/005
2018/0029729 A1 * 2/2018 Kim ..... B65B 3/04
2018/0263853 A1 * 9/2018 Yang ..... A61J 7/0084

* cited by examiner

BLISTER PACKING DEVICE AND BLISTER PACK PACKING METHOD

CROSS-REFERENCE TO RELATED APPLICATIONS

This application claims priority from Korean Patent Application No. 10-2017-0032956, filed on Mar. 16, 2017, in the Korean Intellectual Property Office, the disclosure of which is incorporated herein by reference in its entirety.

BACKGROUND OF THE INVENTION

Field of the Invention

Apparatuses and methods consistent with exemplary embodiments relate to a blister packing device, and more particularly, to a blister packing device capable of being downsized and accurately supplying prescription-based tablets to a blister cup.

Description of the Related Art

In general, blister packing devices may refer to devices which supply tablets to correspond to cups of a blister pack according to a prescription. The cups of the blister pack are configured of cups divided according to items, for example, a day of the week, morning, lunch, evening, before a bedtime, and the like in a row and a column.

Devices which supply and pack tablets to a blister pack may transfer the tablets to the cups of the blister pack through the moving of a main hopper. Accordingly, a method of moving the blister pack may be used in the blister packing due to inconvenience according to the moving of the main hopper.

In response to the tablets being received in the cups of the blister pack located to correspond to an outlet of the main hopper, the tablets may be transferred to the cups of the blister pack while positions of the cups of the blister pack are sequentially moved.

In response to the main hopper being moved, the blister packing device may further require additional power. In response to the main hopper or the blister cup being moved, the volume of the blister packing device may be increased according to a moving path of the main hopper or the blister cup.

SUMMARY OF THE INVENTION

Exemplary embodiments may overcome the above disadvantages and other disadvantages not described above. Also, an exemplary embodiment is not required to overcome the disadvantages described above, and an exemplary embodiment may not overcome any of the problems described above.

One or more exemplary embodiments relate to a blister packing device capable of being downsized and accurately supplying prescription-based tablets to a blister cup.

According to an aspect of an exemplary embodiment, there is provided a blister packing device including a frame; a main hopper attached to the frame and configured to receive tablets; a rotation module located below the main hopper and including a plurality of cells and configured to sequentially receive the tables in the plurality of cells and convey the plurality of cells containing the tablets to a discharge region; and a buffer including a plurality of areas physically divided and configured to receive the tablets in the plurality of areas corresponding to a plurality of cells located in the discharge region and discharge the tablets to a blister pack.

The plurality of cells may be divided by barrier ribs and the plurality of cells containing the tablets may be disposed close to each other in the discharge region.

The plurality of cells located in the discharge region may include one-day tablets and each of the plurality of cells located in the discharge region may include a dose of tablets.

The blister packing device may further include an additional supply unit configured to receive additional tablets and the rotation module may further include a collection region, in which the tablets supplied from the additional supply unit and the main hopper are collected, in any one of the plurality of cells.

The rotation module may further include a top case in which an opening is formed in a position corresponding to the collection region.

The rotation module may further include an openable/closable shutter below the discharge region and an auxiliary hopper configured to guide the discharged tablets to the buffer in response to the shutter being opened.

The auxiliary hopper may form through portions corresponding to the number of cells located in the discharge region.

The buffer may adjust the plurality of areas to correspond to the number of cups included in one row of the blister pack.

The blister packing device may further include an image input unit including a first camera configured to image the tables supplied to a cell and a processor configured to determine whether or not preset tablets are supplied to the cell based on an imaged image of the image input unit.

The image input unit may further include a second camera configure to image tablets loaded in a cup of the blister pack.

The main hopper may be detachably attached to the frame.

The blister packing device may further include a conveying unit located below the buffer; a supply unit located in one side of the conveying unit and configured to load a supply magazine which receives the blister pack; and a unloading unit located in the other side of the conveying unit and configured to load an unloading magazine which receives the blister pack containing the tablets.

The supply unit may move up and down based on the number of blister packs included in the supply magazine and the unloading unit may move up and down based on the number of blister packs included in the unloading magazine.

Coupling grooves may be provided in bottoms of the supply magazine and the unloading magazine and the supply unit and the unloading unit may include coupling protrusions corresponding to the coupling grooves of the supply magazine and the unloading magazine to determine detachably attached positions of the supply magazine and the unloading magazine.

According to an aspect of an exemplary embodiment, there is provided a blister pack packing method including supplying tablets to a main hopper from a tablet cassette; sequentially supplying the supplied tablets to a plurality of cells inside a rotation module located below the main hopper; conveying the plurality of cells containing the supplied tablets to a discharge region through the rotation module; discharging the conveyed tablets to a plurality of areas of a buffer corresponding to a plurality of cells located in the discharge region by opening/closing a shutter of the discharge region; moving the buffer to a position corresponding to one row among rows of the blister pack; and transferring the tablets to a plurality of cups included in the one row of the blister pack through the buffer.

The transferring of the tablets may include simultaneously transferring the tablets to the plurality of cups included in the one row. The tablets transferred to the plurality of cups included in one row may be one-day tablets and the tablets transferred to each of the plurality of cups may be a dose of tablets.

The method may further include moving the buffer to a position corresponding to a lower end of the discharge region. The supplying of the tablets to the moving of the buffer to the position corresponding to the lower end of the discharge region may be repeatedly performed and the moving of the buffer to the position corresponding to the one row of the blister pack may include moving the buffer to a position corresponding to a row next to the one row after the tablets are transferred to the plurality of cups included in the one row of the blister pack.

The blister pack may include seven rows and the method may further include transferring the blister pack to an unloading unit after the tablets are transferred to a plurality of cups in all the rows of the blister pack.

According to the exemplary embodiments, the blister packing device may be miniaturized using a rotation module.

The blister packing device may supply the tablets to a row direction of a blister cup without the moving of a main hopper or the blister cup to the row direction.

The blister packing device may supply and pack the tablets to various blister packs by controlling a plurality of areas of a buffer.

A processor may determine whether or not the tablets are omitted and the tablets are coincided with a prescription based on an imaged image of an image input unit.

Additional aspects and advantages of the exemplary embodiments are set forth in the detailed description, and will be obvious from the detailed description, or may be learned by practicing the exemplary embodiments.

BRIEF DESCRIPTION OF THE DRAWING FIGURES

The above and/or other aspects of the present invention will be more apparent by describing certain exemplary embodiments of the present invention with reference to the accompanying drawings, in which.

DETAILED DESCRIPTION OF THE EXEMPLARY EMBODIMENTS

Figure 1:
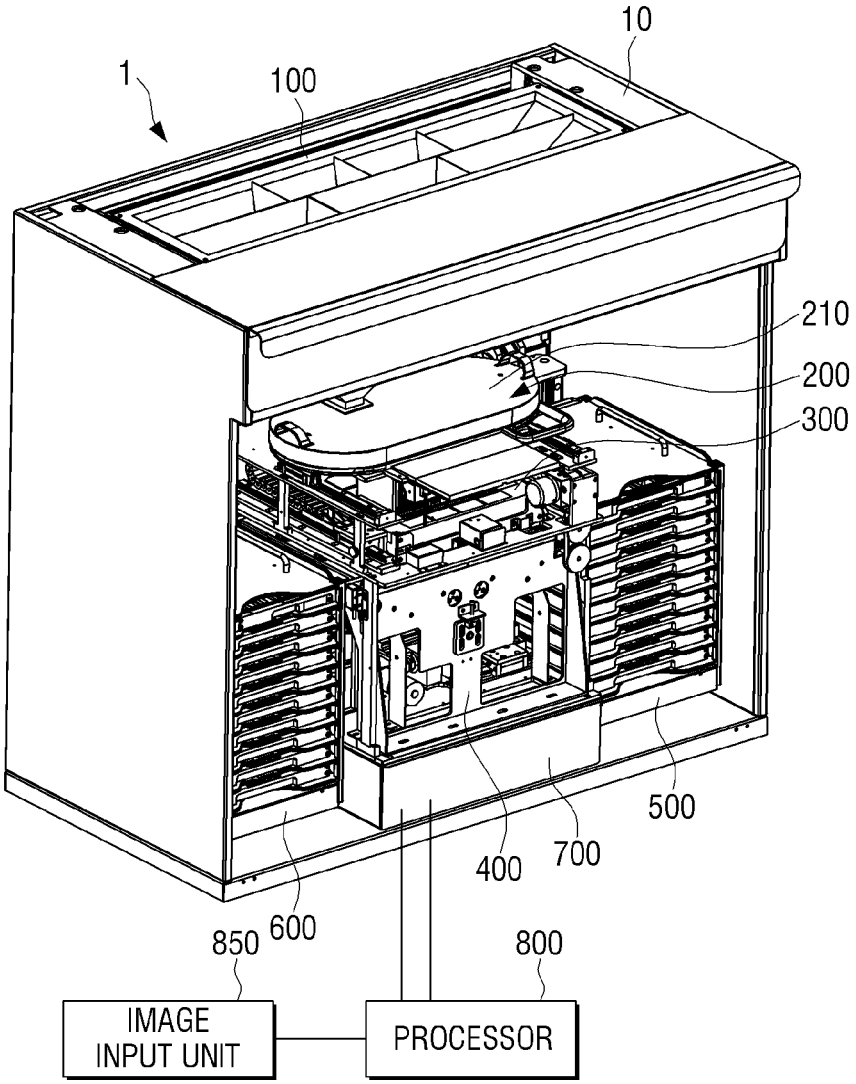
FIG. 1 is a perspective view illustrating a blister packing device according to an exemplary embodiment.

Hereinafter, various embodiments will now be described more fully with reference to the accompanying drawings in which some embodiments are shown. The techniques described herein are exemplary, and should not be construed as implying any particular limitation on the present disclosure. However, in the following description, it is understood that the technology described therein may not be limited to a specific embodiment, and various modifications, equivalents, and/or alternatives of the embodiments may be included therein without departing from the principles and spirit of the present disclosure. In the following description, unless otherwise described, the same reference numerals are used for the same elements when they are depicted in different drawings.

It will be understood that, although the terms first, second, etc. may be used herein in reference to elements of the invention regardless of an order and/or importance, such elements should not be construed as limited by these terms. The terms are used only to distinguish one element from other elements. For example, a first user apparatus and a second user apparatus may refer to different user apparatuses regardless of an order or importance. For example, without departing from the spirit of the inventive concept, a first element may refer to a second element, and similarly, the second element may refer to the first element.

The terminology used herein is for the purpose of describing particular embodiments only and is not intended to be limiting of the scopes of other exemplary embodiments. As used herein, the singular forms "a", "an" and "the" are intended to include the plural forms as well, unless the context clearly indicates otherwise. In embodiments of the invention, the articles "a," "an," and "the" are singular in that they have a single referent; however, the use of the singular form in the present document should not preclude the presence of more than one referent. In other words, elements of the invention referred to in the singular may number one or more, unless the context clearly indicates otherwise. Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein. In some cases, even the terms defined in the present disclosure should not be construed as excluding the exemplary embodiments of the present disclosure.

Hereinafter, a configuration of a blister packing device according to an exemplary embodiment.

Figure 2:
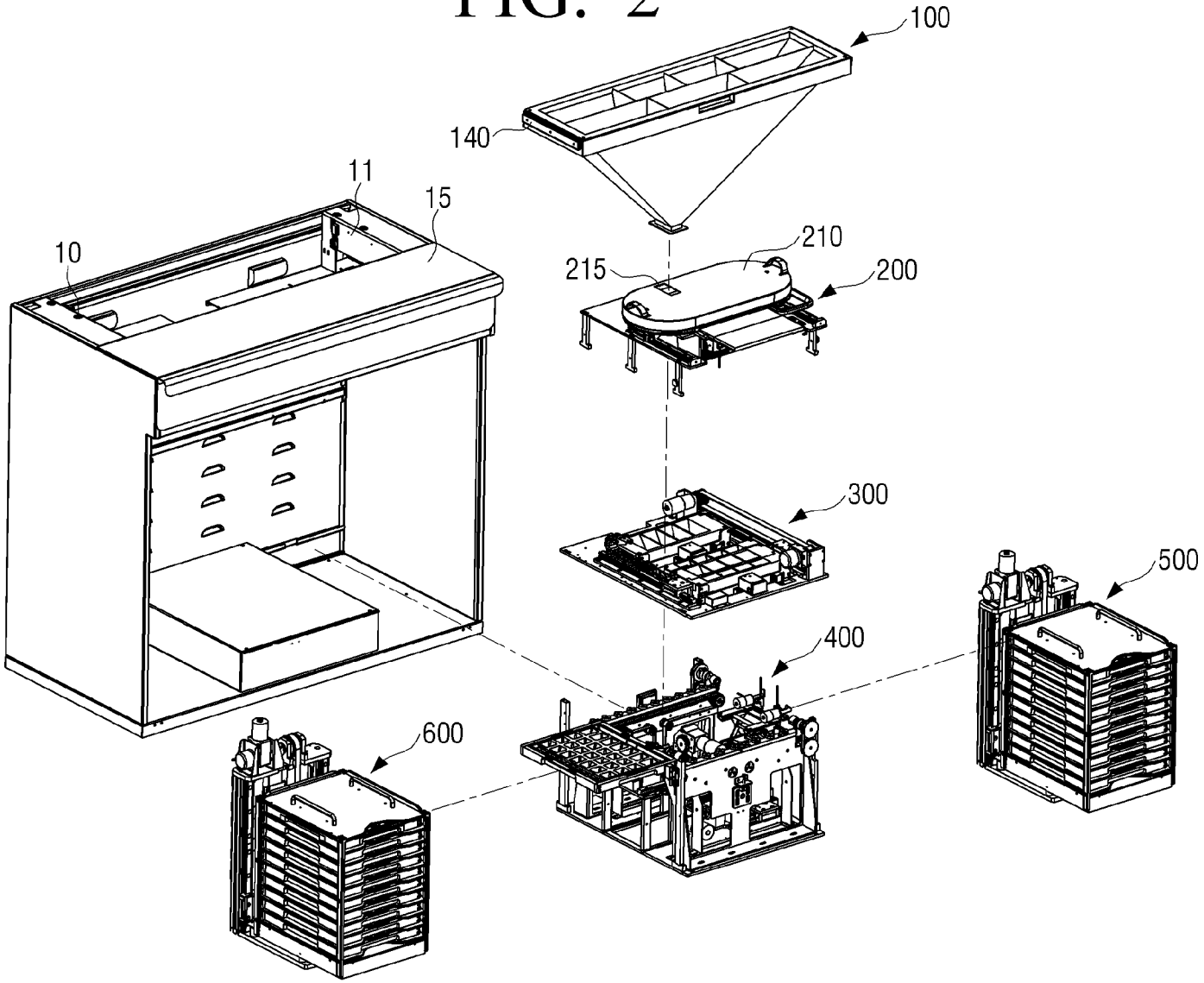
FIG. 2 is an exploded perspective view illustrating a blister packing device according to an exemplary embodiment.

FIG. 1 is a perspective view illustrating a blister packing device according to an exemplary embodiment and FIG. 2 is an exploded perspective view illustrating a blister packing device according to an exemplary embodiment.

Referring to FIGS. 1 and 2, a blister packing device 1 may include a main hopper 100, a rotation module 200, a buffer 300, and a conveying unit 400.

The blister packing device 1 may be installed below a cabinet (not shown) containing tablets. In response to a prescription being input, the tablets contained in a tablet cartridge of the cabinet according to the prescription may be transferred to the main hopper 100.

The plurality of tablets transferred to the main hopper 100 may be collected at one region and transferred to the rotation module 200 through the main hopper 100. The rotation module 200 may include a plurality of cells in the inside thereof and the cells may rotate and sequentially receive the tablets from the main hopper 100.

In response to the tablets contained in the plurality of cells reaching a preset position of the buffer 300, the tablets contained in the plurality of cells may be simultaneously transferred to the buffer 300. The buffer 300 may move forward and backward and simultaneously transfer the tablets stored in the buffer 300 to one row of the blister pack 50.

The conveying unit 400 may be disposed below the buffer 300 and the conveying unit 400 may convey the blister pack 50 below the buffer 300 so that the blister pack 50 may receive the tablets discharged from the buffer 300.

The conveying unit 400 may convey the blister pack 50 below the buffer 300 from the supply unit 500 into which a supply magazine configured to accommodate the blister pack 50 is loaded. The conveying unit 400 may convey the blister pack 50, which receives the tablets transferred from the buffer 300, to an unloading unit 600 into which an unloading magazine is loaded so that the blister pack 50 may be located in the unloading magazine.

The blister packing device 1 may include an electronic box 700 and an image input unit 850. A power unit (not shown) and a processor 800 may be located in the electronic box 700.

The processor 800 may control rotation and forward and backward movement of the rotation module 200 and the buffer 300 and control open/closing of a shutter. The image input unit 850 may image the tablets transferred from the rotation module 200 and image the tablets received in the blister pack 50. The processor 800 may determine, based on an imaged image of the image input unit 850, whether or not the tablets are supplied to the cells moving in the rotation module 200 according to the prescription and determine whether or not the tables are supplied to the blister pack according to the prescription.

Figure 3:
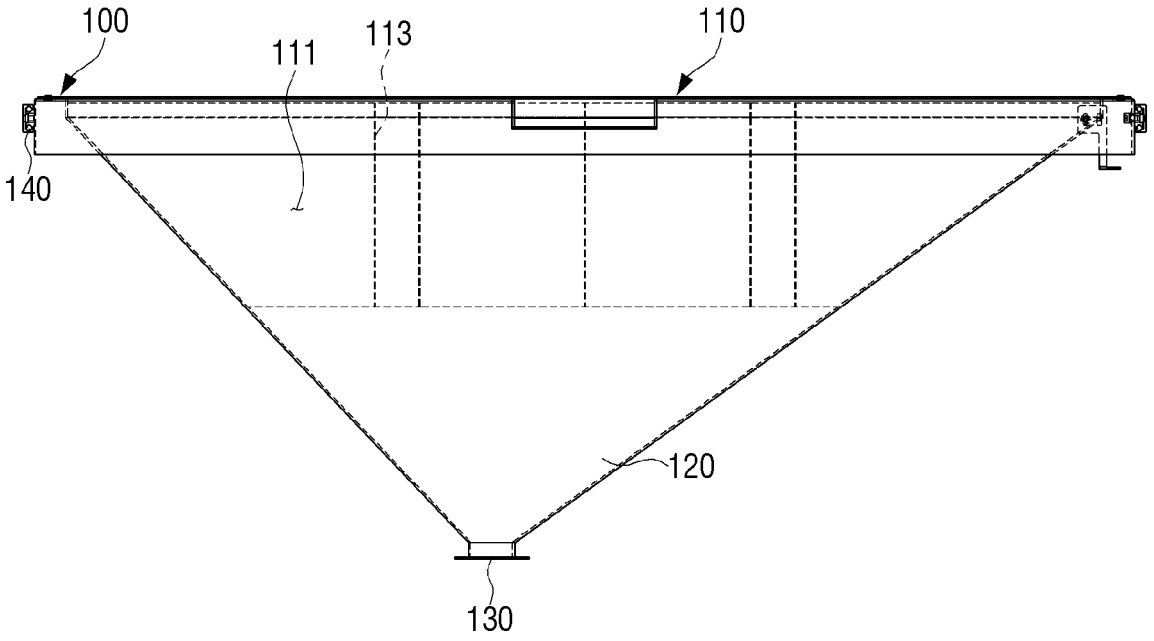
FIG. 3 is a front view illustrating a main hopper according to an exemplary embodiment.

FIG. 3 is a front view illustrating a main hopper according to an exemplary embodiment.

Referring to FIG. 3, the main hopper 100 may include an inlet 110 which is located in an upper portion of the main hopper and the tablets are introduced therethrough and an outlet 130 which is located in a lower portion of the main hopper and the tablets are discharged therethrough. The inlet 110 may have a guide 113 configured to guide the tablets transferred from the cabinet and the tablets may be guided along a space 111 divided through the guide 113. In response to the tablets being transferred to a lower hopper 120 through the load, the lower hopper 120 may guide the transferred tablets to the outlet 130 of the main hopper 100.

The main hopper 100 may be attached to the frame 10. The main hopper 100 may have a sliding pack 140 to be detachably attached to the frame 10 and the sliding pack 140 may be coupled to the frame 10 along a sliding rail of the frame 10. For example, the main hopper 100 may be detachably attached to the frame through a sliding manner as well as a holding manner using a protrusion of the frame. In another example, the main hopper 100 may be detachably attached to the frame through any detachably attachable manner such as screw coupling or hook coupling. However, the detachably attachable method is not limited thereto.

In response to the tablets being piled between the guides 113 or in the lower hopper 120, the tablets may not be suitably discharged. To suitably discharge the tablets, an impact device (not shown) may be used to provide the impact to the main hopper 100. For example, the impact device may be configured to periodically provide the impact to the main hopper. In another example, the impact device may provide the impact to the main hopper 100 in response to the tablets non-reaching the rotation module 200. The impact device may use a solenoid. Any device which may provide other physical impacts may be used as the impact device.

Figure 4:
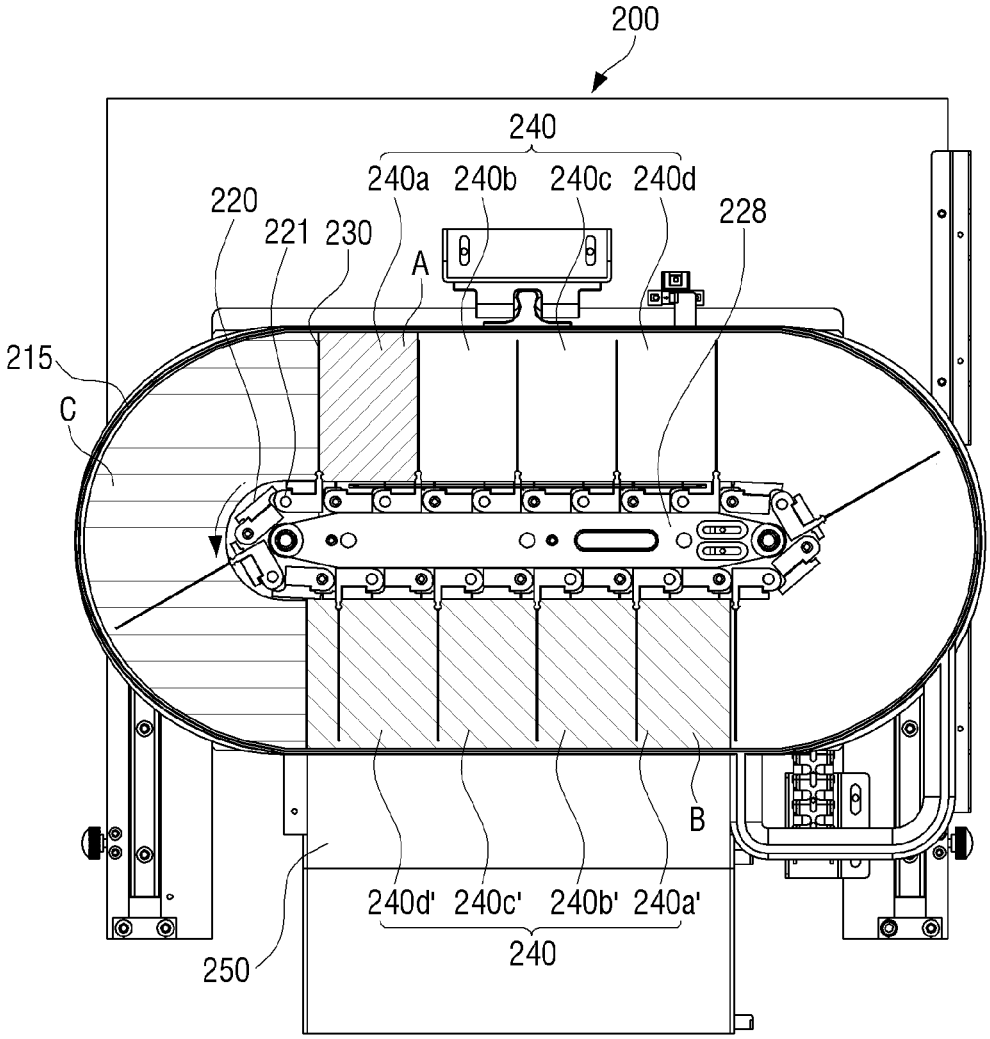
FIG. 4 is a plan view illustrating a rotation module according to an exemplary embodiment.

In response to a top case 210 illustrated in FIG. 1 being omitted, the inside of the rotation module 200 may be configured as illustrated in FIG. 4.

Figure 5:
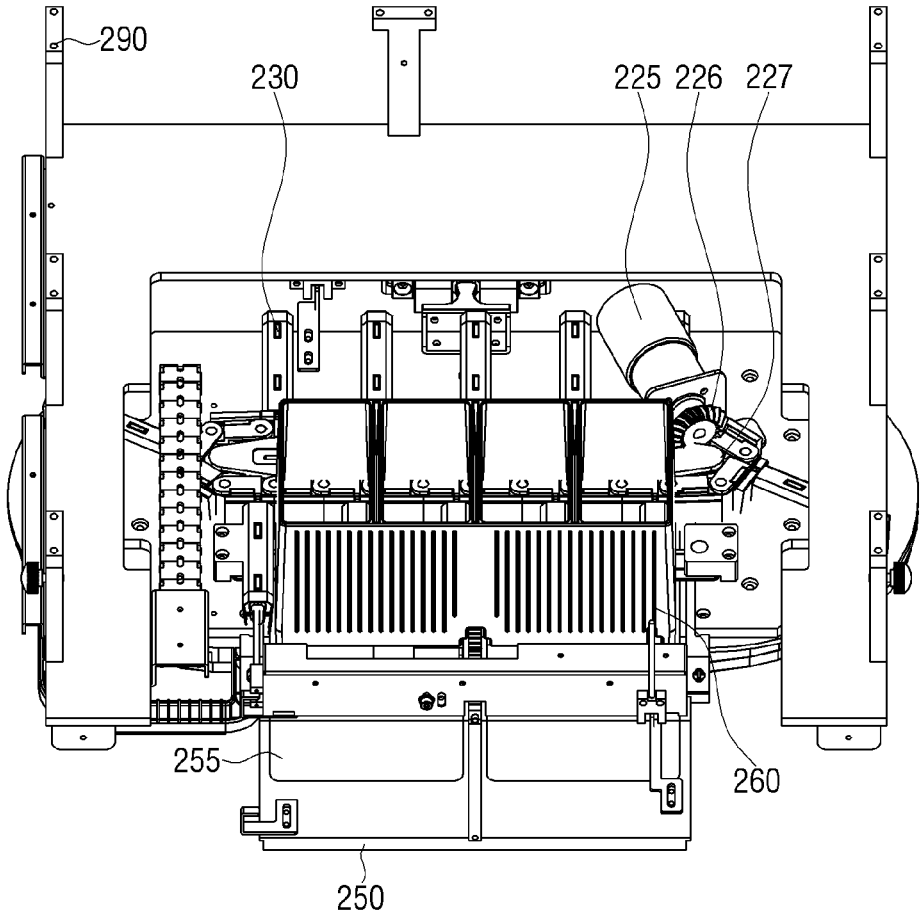
FIG. 5 is a perspective view illustrating a rotation module when viewed from a bottom according to an exemplary embodiment.

FIG. 4 is a plan view illustrating a rotation module according to an exemplary embodiment and FIG. 5 is a perspective view illustrating a rotation module when viewed from a bottom according to an exemplary embodiment.

Referring to FIGS. 4 and 5, the rotation module 200 may include a caterpillar 220, a barrier rib 230, and a discharge unit 250.

The caterpillar 220 may be coupled through a plurality of links 221 to form a closed loop. For clarity, the present disclosure will be described based on the rotation module formed with the caterpillar illustrated in FIG. 4. However, any rotation module which may discharge the tablets to the buffer to correspond to the row of the blister pack without the moving of the main hopper, for example, a rotation module which has cells in a circular rotation plate and rotates may be used as the rotation module.

A collection region A, a discharge region B, and a convey region C may be defined below in the present disclosure.

The collection region A may refer to a region in which a dose of tables taken once are gathered. Referring to FIG. 4, the collection region A may be located below the main hopper 100. The tablets may be supplied from the main hopper 100 through an opening of the top case 210.

In response to an additional supply unit including an additional hopper (not shown) being further included, tablets supplied from the additional hopper may be supplied to cells 240*b*, 240*c*, and 240*d* located before the collection region A. The cells which receives the tablets from the additional hopper may be moved to the collection region A and receive the remaining tablets from the main hopper 100 and thus the dose of tablets taken once may be collected in the collection region A.

A plurality of cells 240*a*', 240*b*', 240*c*', and 240*d*' which contain the tablets collected in the collection region A may be located close to each other in the discharge region B and a region below the discharge region may refer to a region in which a openable/closable shutter 250 is located.

The convey region C may refer to a region in which the tablets collected in the collection region A are conveyed to the discharge region B. For example, referring to FIG. 4, the rotation direction of the rotation module may be a counter-clockwise direction and thus the convey region C may correspond to left regions of the collection region A and the discharge region B.

The barrier ribs 230 may be located at intervals between the links 221 in the caterpillar 220 and the caterpillar 220 may have a side case 215 along the outer sides of the barrier ribs 230. The rotation module 200 may include a plurality of cells 240 in which the tablets are stored through the side case 215 and the barrier ribs 230. The outlet 130 of the main hopper 100 may be located on the collection region A among the plurality of cells 240. The caterpillar 220 may rotate to an arrow direction and the plurality of cells 240 divided through the barrier ribs 230 may also rotate to the arrow direction.

The cells of the rotation module may rotate by moving the barrier ribs 230 through the caterpillar 220, but the cells of the rotation module may rotate by rotating a rotation plate including the plurality of cells.

The main hopper 100 may supply the tablets to the cell 240*a* of the collection region and in response to the empty cell reaching the collection region below the main hopper 100 through the moving of the cell, the tablets may be supplied to the empty cell again. The supplied tablets may move to the discharge region in which the discharge unit 250 is located together with the moving of the cell.

For example, tablets to be taken in the morning according to the prescription may be transferred to the cell 240*a* of the collection region through the main hopper 100 and the cell 240*a* containing the tablets taken in the morning may move to the arrow direction. In response to the cell 240*b* reaching the collection region, tablets to be taken at lunch according to the prescription may be transferred to the cell 240*b* located in the collection region through the main hopper 100 and the cell 240*b* containing tablets to be taken at lunch may move to the arrow direction. Through such a method, the tablets to be taken in the evening may be transferred to the cell 240*c* and tablets to be taken before bedtime may be transferred to the cell 240*d*.

The image input unit 850 may include a first camera (not shown) and the first camera may image the tablets collected in the collection region A. In response to all the tablets being not determined to be collected based on the image imaged through the first camera, the processor 800 may apply vibration or force to the main hopper 100 using a solenoid impact device or an impact device (not shown) through an electrical signal and discharge stagnant tablets to the collection region A. The tablets of which image information is acquired through the first camera may be located in the cell located in the convey region C. The plurality of cells 240*a*, 240*b*, 240*c*, and 240*d* may move and may be located in the discharge region B. The plurality of cells 240*a*', 240*b*', 240*c*', and 240*d*' which move to the discharge region B may contain tablets to be taken for one day. The plurality of cells 240*a*', 240*b*', 240*c*', and 240*d*' may be located close to each other in the discharge region B over the discharge unit 250. The tablets to be taken in the morning may be located in the cell 240*a*', the tablets to be taken at lunch may be located in the cell 240*b*', the tablets to be taken in the evening may be located in the cell 240*c*', and the tablets to be taken before bedtime may be located in the cell 240*d*'. For example, each of the plurality of cells 240*a*', 240*b*', 240*c*', and 240*d*' located over the discharge unit 250 may contain a dose of tablets to be taken once. It has been described that the plurality of cells 240*a*', 240*b*', 240*c*', and 240*d*' are arranged in a row, but the arrangement of the plurality of cells 240*a*', 240*b*', 240*c*', and 240*d*' may be changed according to the arrangement state of the blister cup or a shape of the buffer.

A driving unit 225 may be disposed below the rotation module 200 to rotate the caterpillar 220 configured of the links 221. A driving pinion gear 226 may be coupled to a driving shaft of the driving unit 225. The driving pinion gear 226 may be engaged with a ring gear 227 and thus power may be transferred to a power transfer module 228. The caterpillar 220 engaged with the power transfer module 228 may rotate through the transferred power.

The discharge unit 250 may include a rotation module shutter 255 and an auxiliary hopper 260. The tablets contained in the plurality of cells 240*a*', 240*b*', 240*c*', and 240*d*' in the discharge region B over the discharge unit 250 may be guided to the buffer 300 along through portions of the auxiliary hopper 260 through the opened rotation module shutter 255. The through portions may be formed in the auxiliary hopper 260 to correspond to the number of cells 240*a*', 240*b*', 240*c*', and 240*d*' in the discharge region B over the discharge unit.

The rotation module 200 may include a rotation module support member 290 coupled to the buffer 300 and a length of the support member 290 may be determined according to heights of the auxiliary hopper 260 and the buffer 300.

Figure 6:
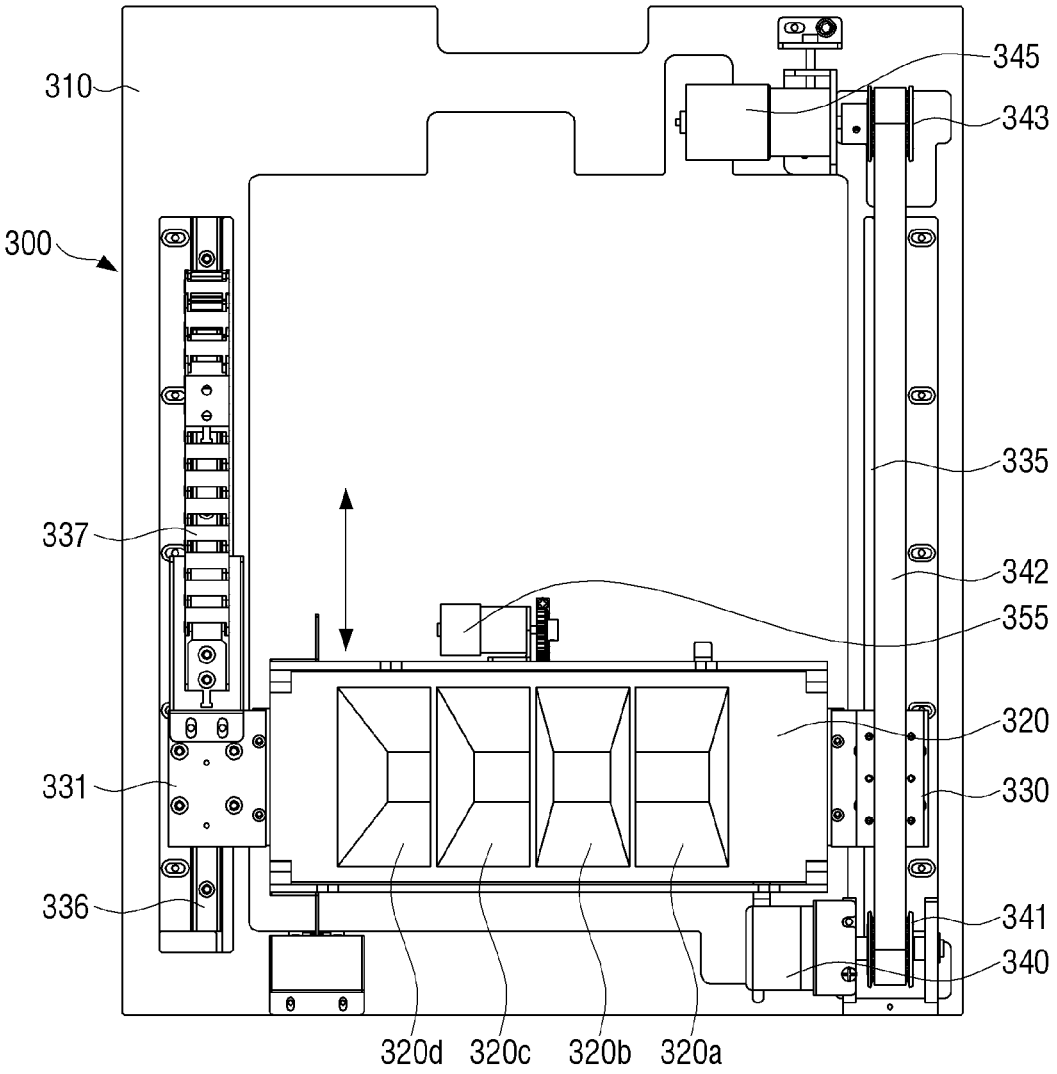
FIG. 6 is a plan view illustrating a buffer according to an exemplary embodiment.
Figure 7:
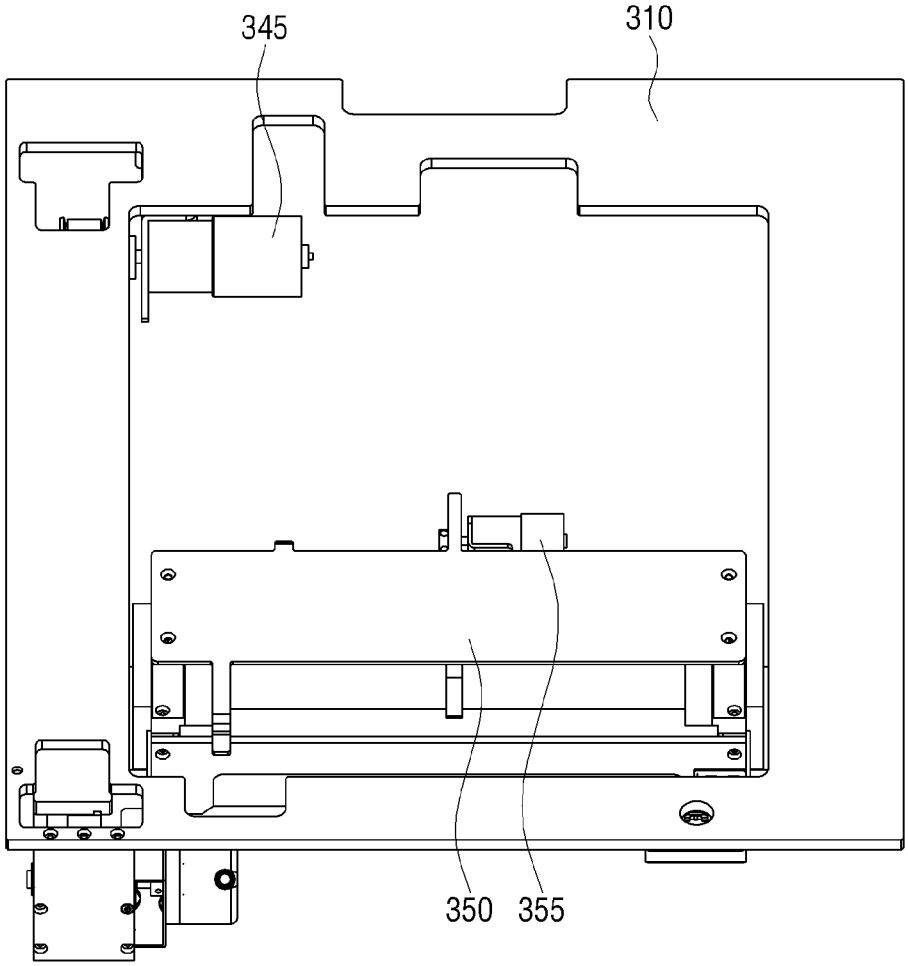
FIG. 7 is a perspective view illustrating a buffer when viewed from a bottom according to an exemplary embodiment.
Figure 8:
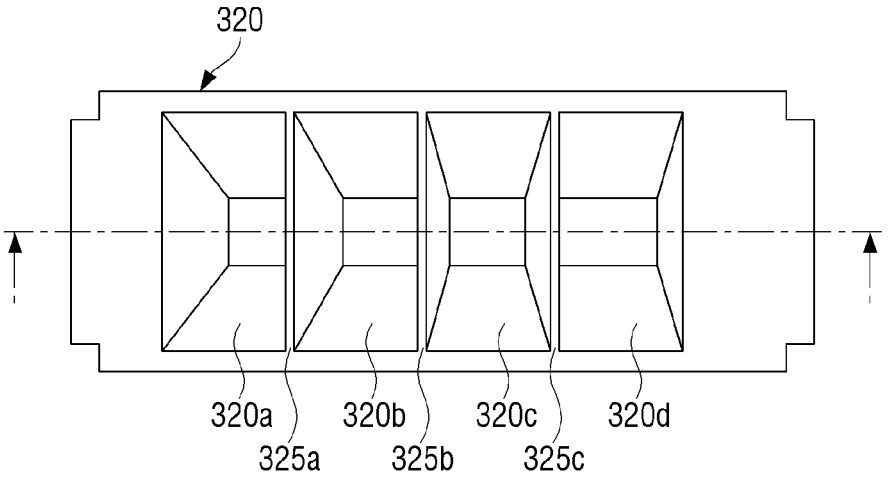
FIG. 8 is a plan view illustrating a tablet holder of a buffer according to an exemplary embodiment.
Figure 9A:
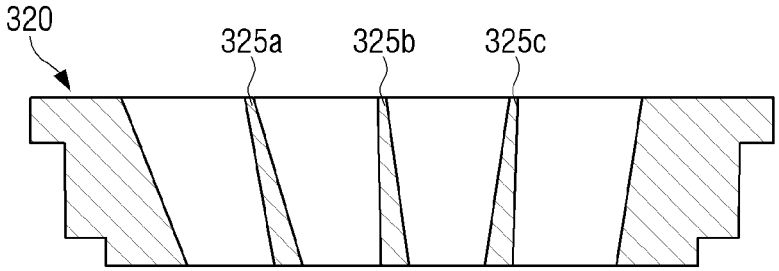
FIG. 9A to FIG. 9C are cross-sectional diagrams illustrating examples that a tablet holder is varied according to an exemplary embodiment.
Figure 9B:
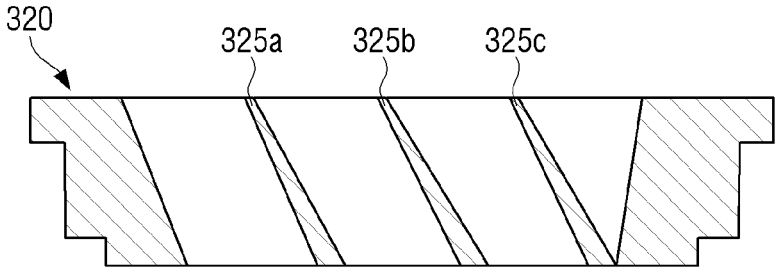
Figure 9C:
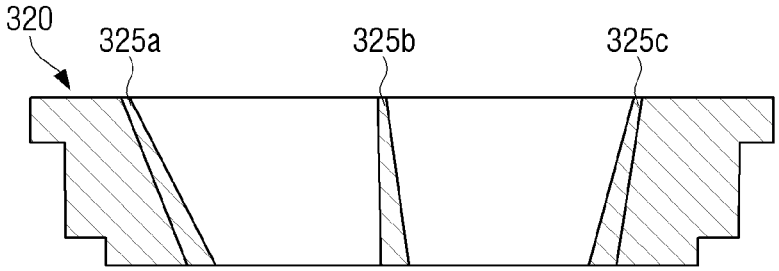

FIG. 6 is a plan view illustrating a buffer according to an exemplary embodiment, FIG. 7 is a perspective view illustrating a buffer when viewed from a bottom according to an exemplary embodiment, FIG. 8 is a plan view illustrating a tablet holder of a buffer according to an exemplary embodiment, and FIG. 9A to FIG. 9C are cross-sectional diagrams illustrating examples that a tablet holder is varied according to an exemplary embodiment.

Referring to FIG. 6, the buffer 300 may be configured of a buffer frame 310 and a tablet holder 320. The tablet holder 320 may be mounted on the buffer frame 310 and the tablet holder 320 may be divided into a plurality of areas 320*a*, 320*b*, 320*c*, and 320*d* physically divided. The plurality of areas 320*a*, 320*b*, 320*c*, 320*d* may have the sizes corresponding to sizes of the plurality of cells 240*a*', 240*b*', 240*c*', and 240*d*' in the discharge region B.

Sliding members 330 and 331 may be attached to a side of the tablet holder 320. The sliding members 330 and 331 may slidably move forward and backward along guide rails 335 and 336. The tablet holder 320 may also move forward and backward through the motions of the sliding members 330 and 331.

The tablet holder 320 may move forward and backward to a position corresponding to a row of the blister pack 50 and transfer the tablets stored in the tablet holder 320 to the blister pack according to the opening/closing of the buffer shutter 350. The tablet holder 320 may move to a position corresponding to a column of the blister pack 50 according to an arrangement of the blister pack 50 and move to a preset position of the blister pack 50.

The sliding members 330 and 331 of the tablet holder 320 may be driven through the driving units 340 and 345. In response to the driving units 340 and 345 being rotated, pulleys 341 and 343 may rotate and a belt 342 coupled to the pulleys 341 and 343 may also rotate. The belt 342 may be coupled to the sliding member 330 and thus the sliding member 330 may move along the guide rail 335. The opposite sliding member 331 may also move forward and backward along the guide rail 336.

The buffer shutter 350 may be opened and closed through the buffer shutter driving unit 355. The buffer shutter 350 may be driven through a rack and a pinion gear and may be driven using a linear motion member such as a linear motor. However, this is not limited thereto and a driving unit using a shape memory alloy and the like may be used.

The tablet holder 320 may include an impact device using a solenoid or a device which provides other physical impacts and in response to the tablets being stagnant in the tablet holder 320 or being not discharged from the tablet holder 320, the tablets which stagnant in the tablet holder may be discharged through the impact device.

FIG. 8 is a plan view illustrating a tablet holder of a buffer and FIG. 9A to FIG. 9C are cross-sectional diagrams illustrating an example that a tablet holder is varied.

Referring to FIG. 8 and FIG. 9A, the tablet holder 320 may include the plurality of areas 320*a*, 320*b*, 320*c*, and 320*d* physically divided. The plurality of areas 320*a*, 320*b*, 320*c* and 320*d* may be divided through guide walls 325*a*, 325*b*, and 325*c*. The guide walls 325*a*, 325*b*, and 325*c* may be varied to change the plurality of areas.

Referring to FIG. 9B, the tablet holder 320 may include three sections which may discharge tablets by varying the guide walls 325*a*, 325*b*, and 325*c* of the tablet holder 320 and referring to FIG. 9C, the tablet holder 320 may include two sections which may discharge tablets by varying the guide walls 325*a*, 325*b*, and 325*c* of the tablet holder 320.

The guide walls 325*a*, 325*b*, and 325*c* may be slidably varied and the shapes of the sections may be determined according to a width of the blister cup. It has been described in the exemplary embodiment that the blister cup has a 4×7 matrix form, but the blister cup may have various matrix forms such as 3×7 or 2×7 and the guide walls 325*a*, 325*b*, and 325*c* may be varied according to such matrix forms. The sections may be varied through only sliding of lower portions of the guide walls 325*a*, 325*b*, and 325*c* or through sliding of the lower and upper portions of the guide walls 325*a*, 325*b*, and 325*c*. Positions of the guide walls 325*a*, 325*b*, and 325*c* of the tablet holder 320 may be manually varied or may be automatically varied through adding of a driving unit.

As illustrated in FIG. 9B, the tablets may be located only in three cells 240*b*, 240*c*, and 240*d* among the plurality of cells in the discharge region B of the rotation module 200 and may be guided to the blister pack along corresponding guide walls of the tablet holder 320.

As illustrated in FIG. 9C, the tablets may be located only in two cells 240*b* and 240*c* among the plurality of cells in the discharge region B of the rotation module 200 and may be guided to the blister pack along corresponding guide walls of the tablet holder 320.

The arrangement examples of the cells have been described in FIG. 9A to FIG. 9C, but the arrangement of the cells is not limited thereto and the positions of the cell may be, for example, three cells 240*a*, 240*b*, and 240*c* among the plurality of cells. In this example, the guide walls 325*a*, 325*b*, and 325*c* may be varied to different positions from each other.

Figure 10:
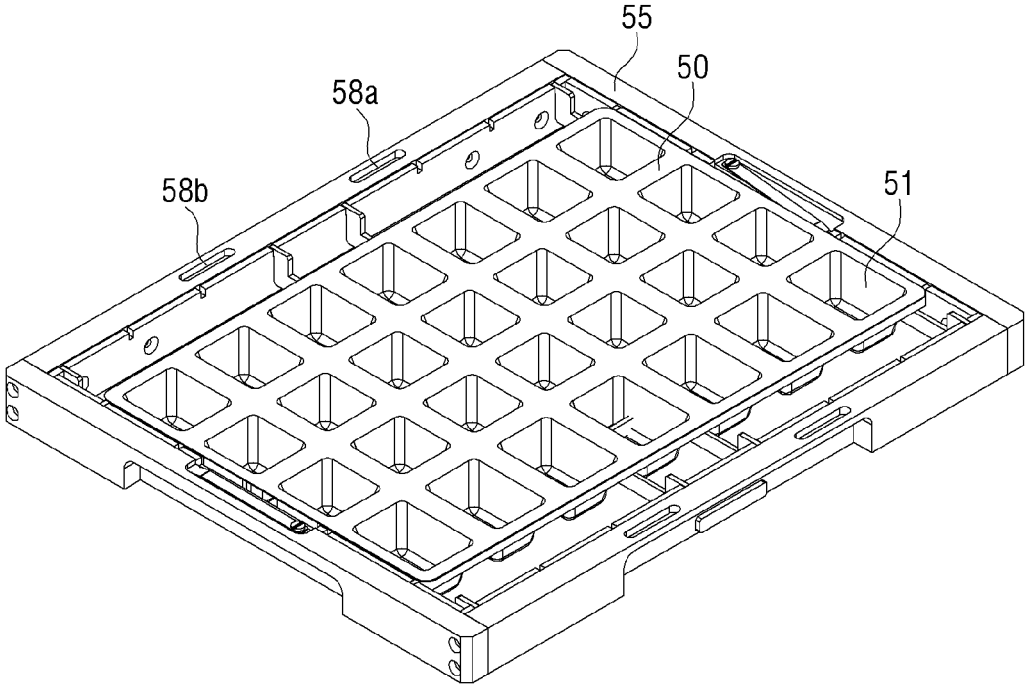
FIG. 10 is a perspective view illustrating a blister pack according to an exemplary embodiment.
Figure 11:
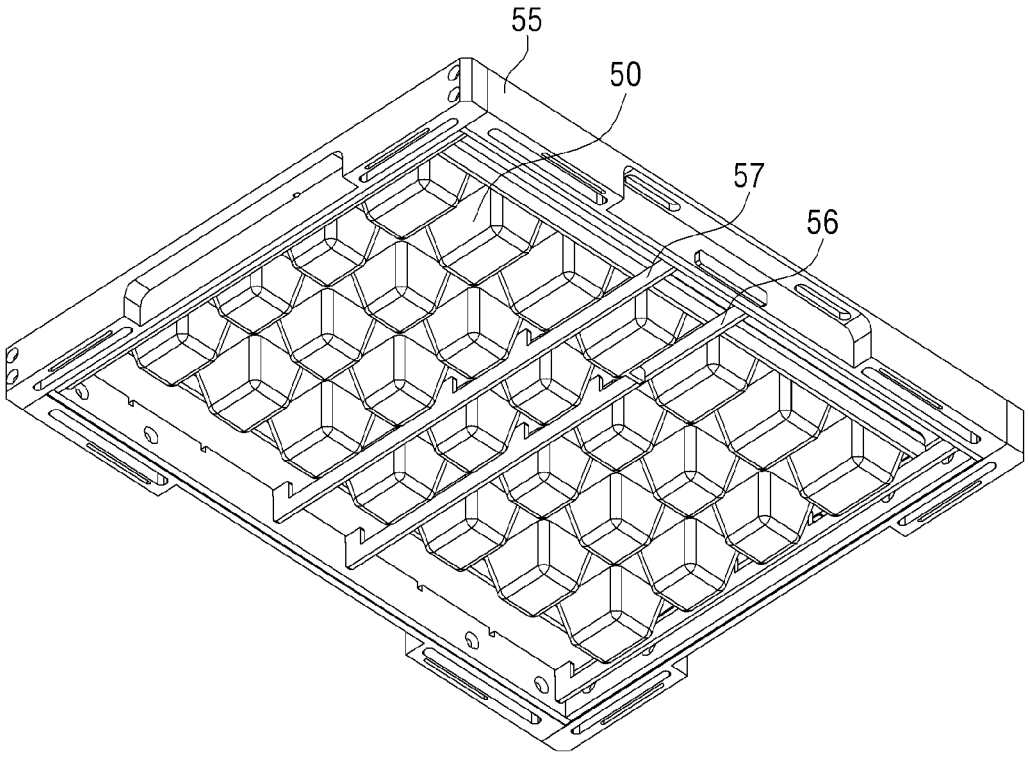
FIG. 11 is a bottom view illustrating the blister pack of FIG. 10.

FIG. 10 is a perspective view illustrating a blister pack attached to a tray according to an exemplary embodiment and FIG. 11 is a bottom view illustrating the blister pack of FIG. 10.

Referring to FIGS. 10 and 11, a tray 55 may include blister pack fixing members 56 and 57. The tray 55 may be formed of a hollow type frame and the blister pack fixing members 56 and 57 may be attached to the tray in a form of cantilever corresponding to rows of the blister pack 50. The blister pack fixing members 56 and 57 may be disposed in middle rows of the blister pack and the blister pack 50 may be mounted on the tray 55.

It has illustrated in FIG. 11 that the blister pack fixing members 56 and 57 are configured of cantilevers corresponding to the rows of the blister pack, but the blister pack fixing members 56 and 57 may be configured of cantilevers corresponding columns of the blister packs.

The blister packs 50 may be configured of blister cups, for example, four cups in a row direction and seven cups in a column direction. Doses of medicines to be taken for one day, for example, in the morning, at lunch, in the evening, and the like may be disposed in the rows of the blister pack and doses of medicines to be taken for days of the week may be disposed in the columns of the blister pack.

The medicines stored in the row of the blister pack 50 may be determined by medicines arranged in a row through the rotation module 200. For example, the tablets of the buffer 300 transferred through the rotation module 200 may be inserted into the cups in the rows of the blister pack 50. While the tablet holder 320 moves, the tablets may be transferred to a row corresponding to a corresponding day of the week according to the prescription.

A second camera (not shown) of the image input unit 850 may determine whether or not tablets are transferred according to the prescription by imaging the tablets transferred to the cup of the blister pack 50. The second camera may be disposed in the conveying unit 400 in which the blister pack 50 is located. The processor may determine whether the tablets are suitably transferred or determine that the tablets are missed in which process of the blister packing device 1 by comparing the images imaged through the first camera and the second camera.

The second camera may determine whether or not the tablets are piled higher than a height of the cup of the blister pack 50 and the processor 800 may provide the notice in response to the piled height of the tablets being larger than the height of the cup of the blister pack.

Figure 12:
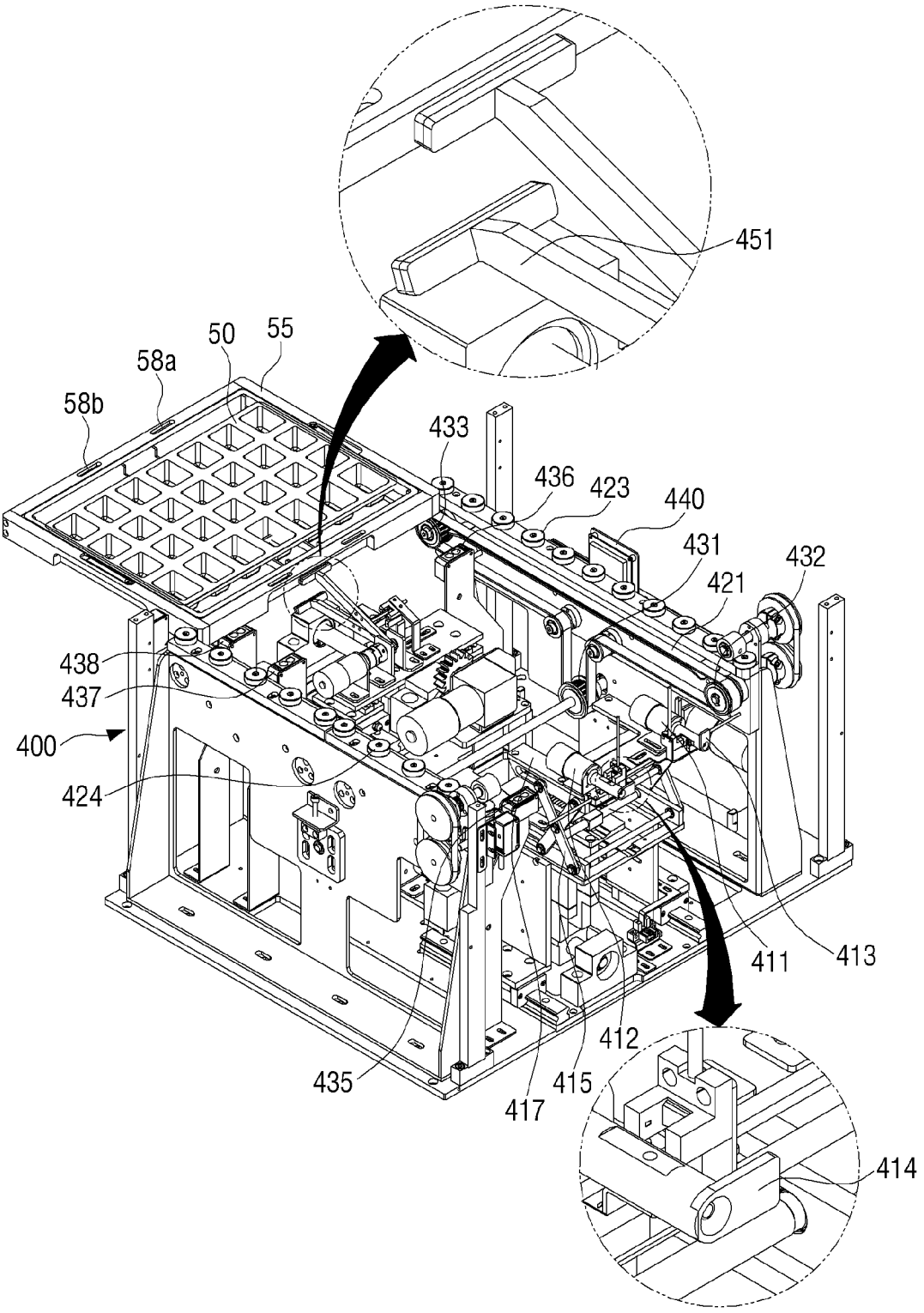
FIG. 12 is a perspective view illustrating a conveying unit according to an exemplary embodiment.

FIG. 12 is a perspective view illustrating a conveying unit according to an exemplary embodiment.

Referring to FIG. 12, the conveying unit 400 may include a loading conveying unit which is located in one side of a conveying conveyer 421 and includes hook motors 411 and 412 and an unloading conveying unit which is located in the other side of the conveying conveyer 421 and includes a push bar 451.

The hook motors 411 and 412 may be disposed on an upper surface of the hook motor support part 417 and hooks 413 and 414 may be disposed in ends of shafts of the hook motors 411 and 412. The hooks 413 and 414 may be locked and unlocked to tray grooves 58*a* and 58*b* and thus may be detachably attached to the tray grooves 58*a* and 58*b*. The hooks 413 and 414 may move toward the tray 55 in the supply unit through the driving of a loading convey driving unit in a state that the hooks 413 and 414 non-protrude upward like the hook 414 disposed in a lower side. In response to the hooks 413 and 414 being disposed upward through the driving of the hook motors 411 and 412 like the hook 413 disposed in an upper side, the hooks 413 and 414 may move upward using a lift 415 to be coupled to the tray 55. The tray 55 may move to the conveying conveyer 421 through the driving of the loading convey driving unit 416. Auxiliary rollers 423 and 424 may smoothly convey the tray 55 conveyed to the conveying conveyer 421.

The position of the tray 55 may be detected through position detectors 435, 436, 437, and 438 and the driving of the conveying conveyer 421 and the auxiliary rollers 423 and 424 may be controlled according to the detected position of the tray 55.

In response to the position of the tray 55 being detected through the first position detector 435, the conveying conveyer 421 and the auxiliary rollers 423 and 424 may be driven and in response to the position of the tray 55 being detected through the second and third position detectors 436 and 437, the driving of the conveying conveyer 421 and the auxiliary rollers 423 and 424 may be stopped. For example, the tray 55 may move to a middle position of the conveying unit and the blister pack 50 may receive the tablets stored in the tablet holder 320. Then, in response to the tray 55 being not detected in the four position detector 438 by the conveying of the blister pack, the unloading conveying unit may move the tray 55 which receives the blister pack 50 containing the tablets to the unloading unit 600 through the push bar 451.

In response to the tablets being contained in the blister pack 50, the conveying unit 400 may seal the blister pack 50. A sealing paper may be placed on the blister pack 50 and may be heated and pressurized through a roller (not shown). The heated and pressurized sealing paper may be fused to the blister pack 50 and information for a patient, date, a time to be taken, and the like may be printed in the sealing paper according to the blister cup 51.

The conveying unit 400 may further include a sensor 440 and the sensor 440 may read the information of the blister pack 50 and transmit the information of the blister pack 50 to the processor 800.

Figure 13:
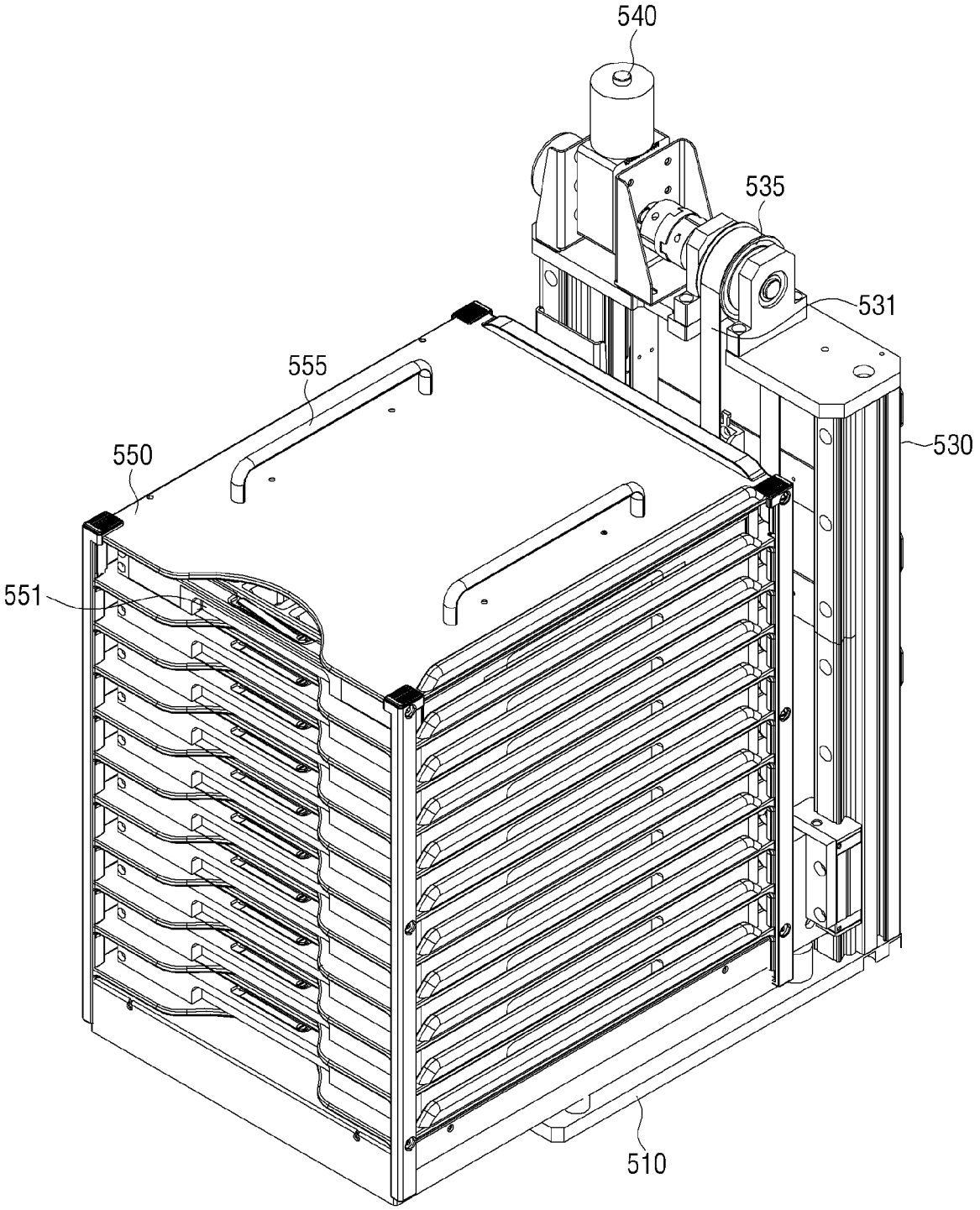
FIG. 13 is a perspective view illustrating a loading unit according to an exemplary embodiment.
Figure 14:
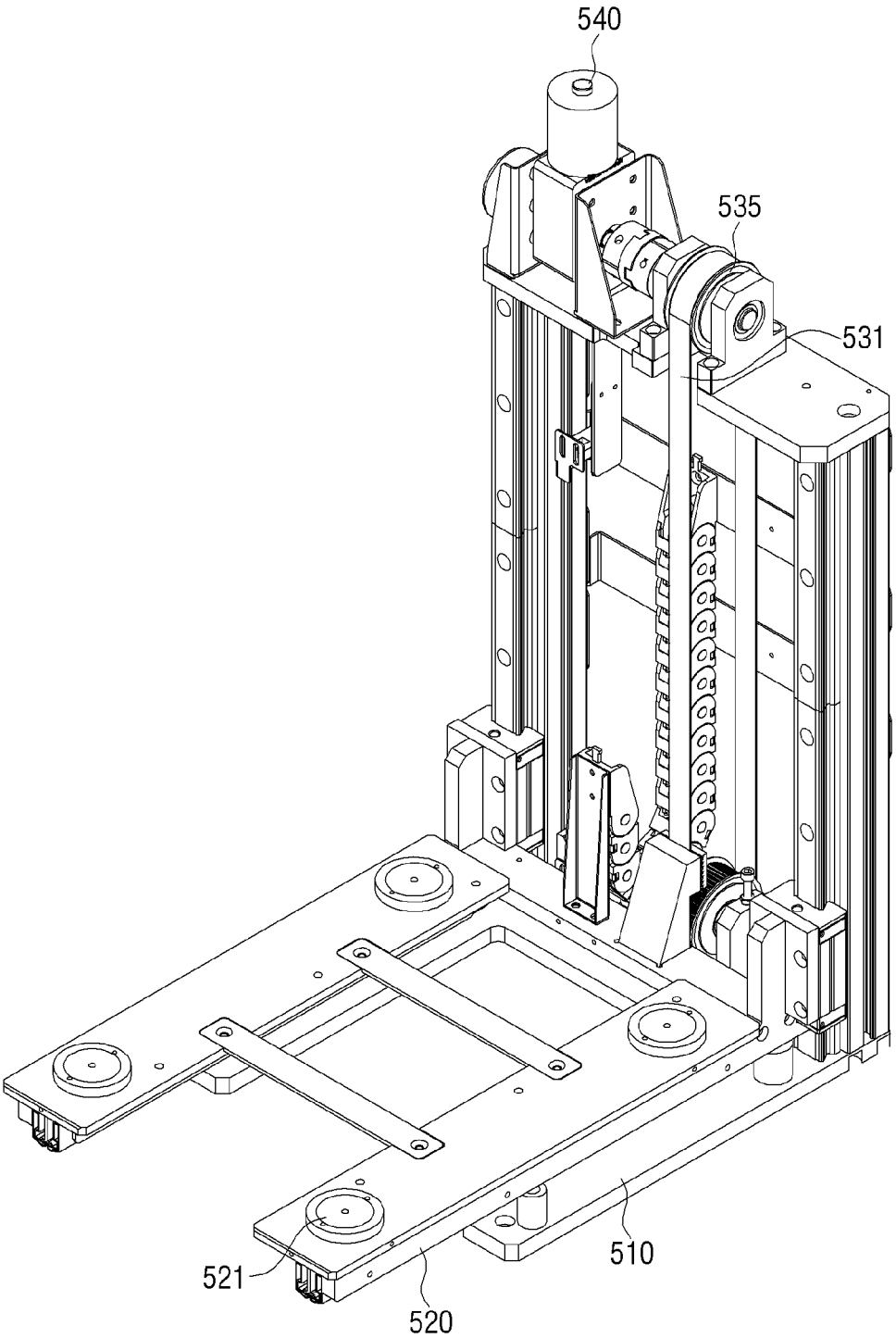
FIG. 14 is a perspective view illustrating an example that a magazine is removed from a loading unit according to an exemplary embodiment.
Figure 15:
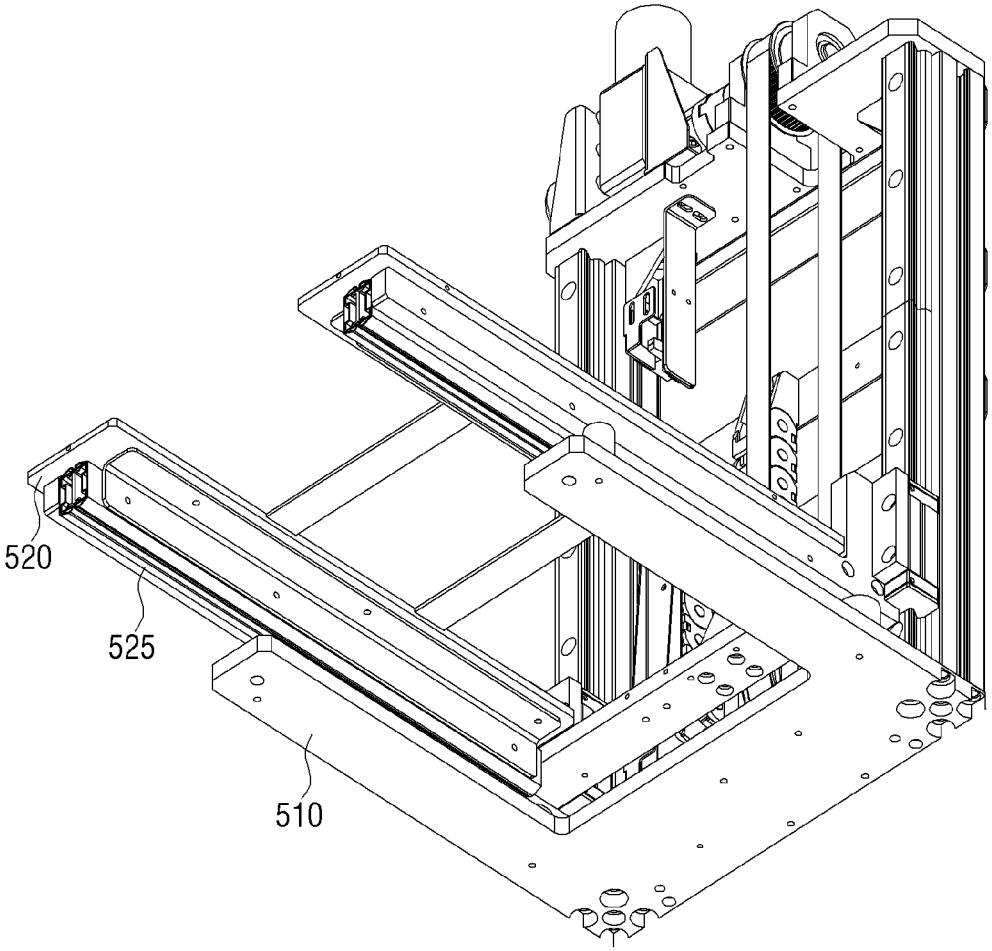
FIG. 15 is a perspective view illustrating a loading unit when viewed from a bottom according to an exemplary embodiment.

FIG. 13 is a perspective view illustrating a loading unit according to an exemplary embodiment, FIG. 14 is a perspective view illustrating an example that a magazine is removed from a loading unit according to an exemplary embodiment, and FIG. 15 is a perspective view illustrating a loading unit when viewed from a bottom according to an exemplary embodiment.

Referring to FIG. 13, the loading unit 500 may include a support 510 and an elevator 530. The magazine 550 may be supported through the support 510.

The magazine 550 may include a handle 555 and the magazine 550 may be detachably attached to the support 510 using the handle 555. The magazine 550 may include a plurality of tray receiving units 551 in which the trays 55 are received. Each of the tray receiving units 551 may detect the hooks 413 and 414 of the loading conveying unit.

Referring to FIG. 14, the supply unit 500 may include a magazine seating unit 520 on the support 510 of the supply unit 500. The magazine seating unit 520 may include a circular protrusion 521 on an upper surface thereof. A coupling groove (not shown) corresponding to the coupling protrusion 521 may be included in a lower surface of the magazine 550 and the magazine 550 may be fixed to a fixed position through the coupling of the coupling groove and the coupling protrusion 521.

The elevator 530 may include a driving belt 531, an elevation driving pulley 535, an elevation driven pulley 536, and an elevation driving unit 540. The elevation driving pulley 535 may rotate through the driving of the elevation driving unit 540 and thus the driving belt 531 may rotate. The support 510 coupled to the driving belt 531 may move up and down through the rotation of the driving belt 531.

The support 510 may move to the heights of the hooks 413 and 414 according to the position of the tray 55 to be withdrawn and the hooks 413 and 414 of the loading conveying unit may move to the tray receiving unit 551 and convey the trays 55.

Although only the structure of the supply unit 500 is described, the structure of the unloading unit 600 may be the same as that of the supply unit 500. Merely, in the driving method, an elevating height may be determined according to the position of the tray receiving unit 551 in which the trays 55 to be loaded are to be stored.

The blister pack 50 may be withdrawn from the uppermost layer of the magazine 550 and the blister pack 50 to be withdrawn next may be withdrawn from a layer just below the uppermost layer and thus the magazine 550 may move up through the elevator 530. In response to the blister pack 50 being withdrawn from the lowermost layer, the blister pack 50 to be withdrawn next may be withdrawn from a layer just over the lowermost layer and thus the magazine 550 may move down through the elevator 530.

Even in the unloading unit 600, the magazine 550 may move down to store the blister packs 50 in response to the blister pack 50 being stored from the lowermost layer and the magazine 550 may move up to store the blister packs 50 in response to the blister pack 50 being stored from the uppermost layer.

For example, the supply unit 500 and the unloading unit 600 may move up and down the magazine 550 according to the withdrawing order of the blister packs based on the number of blister packs 50.

The magazine seating unit 520 may be slidable on the support 510. A sliding rail 525 may be provided on a bottom of the magazine seating unit 520 and the support 510 may include a groove corresponding to the sliding rail, an engageable gear, a roller, and the like so that the magazine seating unit 520 may be slidable. The magazine seating unit 520 may discharge the magazine 550 to a front side through the sliding. The magazine 550 may be detachably attached to the magazine seating unit 520 through the handle 555 in a state that the magazine seating unit 520 is discharged to the front side.

An operation of the blister packing device having the above-described configuration according to an exemplary embodiment will be described. The magazine 550 may be placed on the magazine seating unit 520 in a state that the magazine seating unit 520 of the supply unit 500 is discharged in the front side. The magazine seating unit 520 may be moved backward and thus the magazine seating unit 520 may move to a position to which the tray 55 included in the magazine 550 may be supplied.

The contents of the prescription based on a bar code described in the prescription or a printed recognition code may be received through a recognition unit (not shown) provided in the cabinet. Before tablets are provided according to the input prescription, the tray 55 including the blister pack 50 in the inside of the magazine 550 may be moved through the loading conveying unit of the conveying unit 400. The tray grooves 58*a* and 58*b* may be coupled to the hooks 413 and 414. The tray 55 may be moved to the conveying conveyer 421 through a driving unit provided in the loading conveying unit.

The conveying conveyer 421 and the auxiliary rollers 423 and 424 may move the tray 55 to the second and third position detectors 436 and 437. In response to the tray 55 being moved to the second and third position detectors 436 and 437, the sensor 440 may transmit information of the blister pack 50 to the processor 800 and the processor 800 may simultaneously store the information of the blister pack 50 and the prescription of the patient and thus may identify the patient corresponding to the tablets stored in the blister pack.

Figure 16:
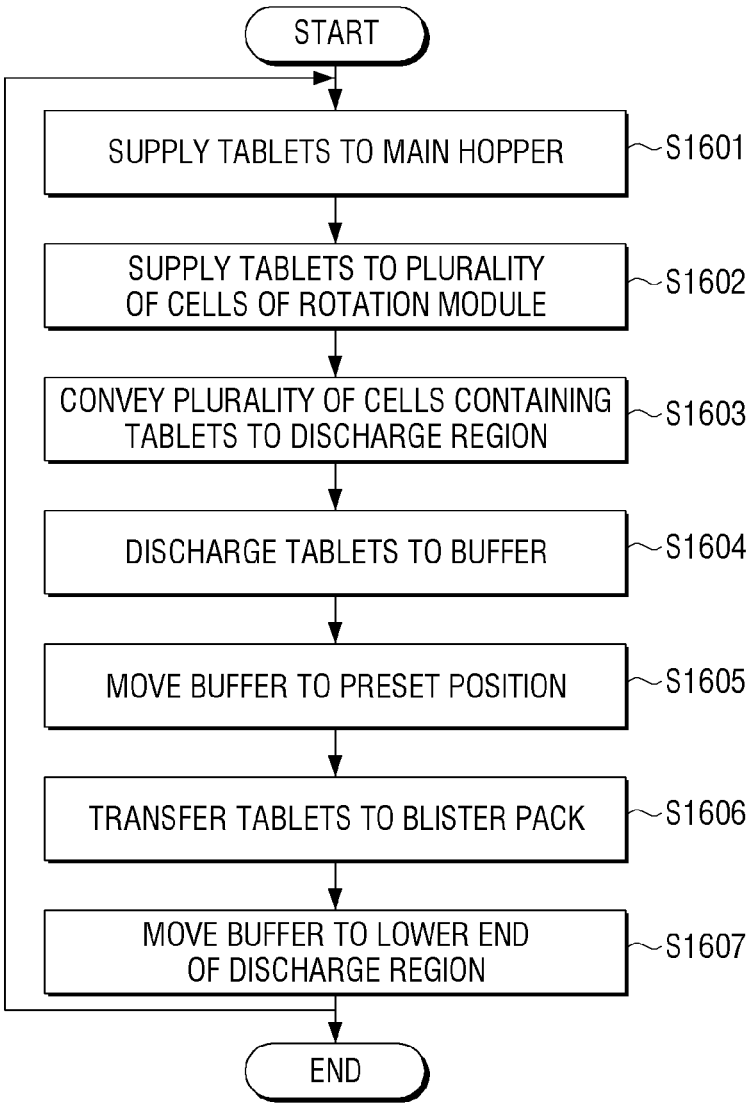
FIG. 16 is a flowchart illustrating a blister pack packing method according to an exemplary embodiment.

FIG. 16 is a flowchart illustrating a blister pack packing method according to an exemplary embodiment. A process of supplying the tablets to the conveyed blister pack will be described with reference to FIG. 16. In response to the blister pack 50 being located below the buffer 300, the tablets according to the prescription may be transferred to the main hopper 100 from cartridges of a cabinet (S1601).

The plurality of tablets transferred to the main hopper 100 may be collected in one space of the lower hopper 120 and guided to the outlet 130. The tablets guided to the outlet 130 may be transferred to the collection region A of the rotation module 200. In response to the tablets to be taken in the morning according to the prescription being transferred to the cell 240*a* located in the collection region A, the plurality of cells 240 of the rotation module 200 may be rotated and the next cell 240*b* may be located in the collection region A.

The tablets to be taken at lunch according to the prescription may be transferred to the collection region A of the rotation module through the main hopper 100 and the tablets to be taken at lunch may be stored in the cell 240*b* located in the collection region A. According to the above-described process, the tablets to be taken in the evening and the tablets to be taken before bedtime may be transferred to the cells 240*c* and 240*d* to be located in the collection region A according to the rotation of the rotation module 200 through the main hopper (S1602).

The tablets to be taken in the morning, at lunch, and in the evening according to the prescription may be stored in the cells 240*a*, 240*b*, and 240*c* to be located in the collection region A and the cell 240*d* may be provided with the tablets to be taken in the next morning or may be empty.

The stored tablets may be moved to the discharge region B located over the discharge unit 250 and the plurality of cells 240*a*', 240*b*. 240*c*', and 240*d*' may be arranged in the discharge region B (S1603). The tablets to be taken in the morning may be located in the cell 240*a*, the tablets to be taken at lunch may be located in the cell 240*b*', the tablets to be taken in the evening may be located in the cell 240*c*', and the tablets to be taken before bedtime may be located in the cell 240*d*'.

While the plurality of cells 240*a*', 240*b*', 240*c*', and 240*d*' move to the discharge region B, the plurality of cells 240*a*', 240*b*', 240*c*', and 240*d*' may pass through the convey region C of the rotation module 200. The tablets of which image information is acquired through a first camera of the image input unit 850 may be located in the convey region C. The processor 800 may determine whether or not the tablets according to the prescription reach the cell located in the rotation module 200 based on the acquired image information.

In response to the rotation module shutter 255 being opened in the discharge region B of the rotation module 200, the tablets stored in the plurality of cells 240*a*', 240*b*', 240*c*', and 240*d*' may be discharged to the buffer 300 according to the guidance of the auxiliary hopper 260 (S1604). The tablets may be stored in the plurality of areas 320*a*, 320*b*, 320*c*, and 320*d* of the tablet holder 320 of the buffer 300.

The tablet holder 320 may move to the preset position of the blister pack 50 corresponding to a day of the week corresponding to the prescription (S1605). In response to the buffer shutter 350 being opened, the tablets stored in the tablet holder 320 may be transferred to the cups of the blister pack 50 of the corresponding day of the week (S1606).

The tablet holder 320 may move to the lower end of the discharge region B of the discharge unit 250 and stand by until tablets corresponding to next day of the week are transferred (S1607). The tablets of the next day of the week according to the prescription may be transferred to the tablet holder 320 from the main hopper 100 via the rotation module 200.

The tablet holder 320 may move to a row of the blister pack 50 corresponding to the next day of the week according to the prescription, the buffer shutter 350 may be opened, and thus the tablets stored in the tablet holder 320 may be transferred to the row of the blister pack 50. All the tablets according to the prescription of the patient may be stored in the blister pack 50 through the repetition of the above-described process.

In response to the tablets being transferred to the blister pack 50 through the tablet holder 320, a second camera of the image input unit 850 may image the tablets stored in the blister cups. The processor 800 may determine whether or not the tablets are transferred without omission by comparing the imaged image of the first camera and the imaged image of the second camera. The processor 800 may determine whether or not the tablets according to the prescription are omitted in the transfer process based on the imaged image of the second camera.

The second camera may be configured to image the tablets for each cup 51 of the blister pack or to image the tablets for one row. The processor 800 may determine whether or not the tablets are piled above the height of the blister cup based on the imaged image of the second camera. In response to the tablets being piled above the height of the blister cup, the processor 800 may provide the alarm to the user.

In response to the tablets being suitably transferred to the blister pack 50, the blister pack 50 may be sealed with a sealing paper and the information for the patient, a day of the week, a time to be taken, and the like may be printed in a portion of the sealing paper located on the upper surface of the corresponding blister cup 51.

The tray 55 in which the blister pack 50 is contained may be conveyed through the conveying conveyer 421 and the auxiliary rollers 423 and 424. In response to the tray 55 being not detected in the fourth position detector, the push bar 451 may move upward and convey the tray 55 to the unloading unit 600.

The tray 55 may be stored in the tray receiving unit 551 of the magazine 550 located in the unloading unit 600 and in response to all the trays 55 stored in the magazine 550 being piled, the magazine 550 may move to a front side. The user may move the magazine 550 using the handle 555.

For example, the blister packing device 1 may need to preferentially prepare tablets urgently during the using of the blister packing device. In this example, an input unit (not shown) of the cabinet may input an emergency preparation command. In response to the emergency preparation command being input, the blister packing device 1 may terminate the packing of the blister pack 50 which is currently worked and stop.

The user may load the tray 55 including an empty blister pack 50 into the tray receiving unit 551 located in the uppermost layer of the magazine 550 located in the supply unit 500. Then, like the above-described process, the tray 55 may move below the buffer 300 through the conveying unit 400 and in response to all the tablets according to the prescription being contained in the blister pack 50, the tray 55 may be conveyed to the unloading unit 600. The user may withdraw the conveyed tray 55 from the magazine 550 stored in the unloading unit 600.

The blister pack 50 may be inserted according to the prescription and the processor 800 may automatically vary the guide walls 325*a*, 325*b*, and 325*c* of the tablet holder 320 to correspond to the blister pack 50 or the user may manually vary the guide walls 325*a*, 325*b*, and 325*c* of the tablet holder 320 to correspond to the blister pack 50. Accordingly, the blister packing device 1 may use blister packs having various matrix forms.

As described above, the blister packing device 1 according to an exemplary embodiment may use the rotation module 200. The rotation module 200 may simultaneously transfer the tablets corresponding to the row of the blister pack 50 to the row of the blister pack. Accordingly, it is not necessary for the main hopper 100 to move to the row direction or for the blister pack 50 to move to the row direction. In the moving of the main hopper 100 or the blister pack 50, the tablets may be transferred to one cup once. However, the tablets may be simultaneously transferred to the tablet holder 320 and thus the preparation time may be shortened in the exemplary embodiment.

Accordingly, the moving time of the blister pack 50, the main hopper 100, and the like to the horizontal direction may be shortened. The rotation module 200 may move to the fixed discharge unit and transfer the tablets to a first tablet holder and thus the tablets may be accurately transferred. The blister packing device 1 may have high space utility by removing the moving to the row direction.

The image input unit 850 may be added to the rotation module 200 and the conveying unit 400 in which the blister pack 50 receives the tablets in the exemplary embodiment. The processor 800 may determine whether or not the tablets omitted in the tablet transfer process are present based on the imaged image of the image input unit 850 and before the sealing of the blister pack, the processor 800 may determine whether or not the packing is possible and to provide the determination result to the user.

The magazine 500 may be detachably attached to the support 510 in one set so that the user may easily convey the magazine 500. The support 510 may move up and down and thus the conveying unit 400 may automatically receive the tray.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A blister packing device comprising:

a frame;

a main hopper attached to the frame and configured to receive tablets;

a rotation module located below the main hopper and including a plurality of cells and configured to sequentially receive the tablets in the plurality of cells and convey the plurality of cells containing the tablets to a discharge region;

a buffer including:

a tablet holder physically divided into a plurality of areas and configured to receive the tablets in the plurality of areas corresponding to members of the plurality of cells located in the discharge region and discharge the tablets to a blister pack formed in a matrix;

a buffer frame configured to slidably support the tablet holder that moves to a position corresponding to one row among rows of the blister pack; and an openable/closable buffer shutter below the tablet holder that transfers the tablets stored in the tablet holder to the one row of the blister pack; and an openable/closable shutter below the discharge region to discharge the conveyed tablets to the plurality of areas of the buffer.

2. The blister packing device as claimed in claim 1, wherein the plurality of cells are divided by barrier ribs and the plurality of cells containing the tablets are disposed close to each other in the discharge region.

3. The blister packing device as claimed in claim 1, wherein the plurality of cells located in the discharge region are configured to hold one-day tablets and each of the plurality of cells located in the discharge region includes a dose of tablets.

4. The blister packing device as claimed in claim 1, further comprising:

an auxiliary hopper configured to guide the discharged tablets to the buffer in response to the shutter being opened.

5. The blister packing device as claimed in claim 4, wherein the auxiliary hopper forms through portions corresponding to the number of cells arranged in the discharge region.

6. The blister packing device as claimed in claim 1, wherein the buffer adjusts the plurality of areas to correspond to the number of cups included in one row of the blister pack.

7. The blister packing device as claimed in claim 1, further comprising:

an image input unit including a first camera configured to image the tablets supplied to a cell; and a processor configured to determine whether or not preset tablets are supplied to the cell based on an imaged image of the image input unit, wherein the image input unit further includes a second camera configured to image tablets loaded in a cup of the blister pack.

8. The blister packing device as claimed in claim 1, wherein the main hopper is detachably attached to the frame.

9. The blister packing device as claimed in claim 1, further comprising:

a conveying unit located below the buffer;

a supply unit located in one side of the conveying unit and configured to allow a supply magazine which receives the blister pack to be loaded on the supply unit; and an unloading unit located in the other side of the conveying unit and configured to allow an unloading magazine which receives the blister pack containing the tablets to be loaded on the unloading unit.

10. The blister packing device as claimed in claim 9, wherein the supply unit moves up and down based on the number of blister packs included in the supply magazine, and the unloading unit moves up and down based on the number of blister packs included in the unloading magazine.

11. The blister packing device as claimed in claim 9, wherein coupling grooves are provided in bottoms of the supply magazine and the unloading magazine and the supply unit and the unloading unit include coupling protrusions corresponding to the coupling grooves of the supply magazine and the unloading magazine, and the coupling protrusions detachably attach to the coupling grooves of the supply magazine and the unloading magazine.

12. The blister packing device as claimed in claim 1, further comprising:

an additional supply unit configured to receive additional tablets.

13. The blister packing device as claimed in claim 12, wherein the rotation module further includes a collection region, in which the tablets supplied from the additional supply unit and the main hopper are collected, in any one of the plurality of cells, and the rotation module further includes a top case in which an opening is formed in a position corresponding to the collection region.

* * * * *